United States Patent [19]

Hanson

[11] Patent Number: 5,057,273

[45] Date of Patent: Oct. 15, 1991

[54] METHOD FOR UNIAXIAL COMPACTION OF MATERIALS IN A COLD ISOSTATIC PROCESS

[75] Inventor: Andrew D. Hanson, Derry, N.H.

[73] Assignee: Industrial Materials Technology, Inc., Andover, Mass.

[21] Appl. No.: 620,159

[22] Filed: Nov. 29, 1990

[51] Int. Cl.[5] ..... B22F 1/00

[52] U.S. Cl. ..... 419/68; 419/49; 264/500

[58] Field of Search ..... 419/49, 68; 264/500

[56] References Cited

U.S. PATENT DOCUMENTS 4,599,215 7/1986 Smarsly et al. ..... 419/68

*Primary Examiner*—Stephen J. Lechert, Jr.

*Attorney, Agent, or Firm*—James E. Maslow

[57] ABSTRACT

A cold isostatic pressing method and apparatus using fluid pressure to compact a material charge held in a flexible mold, including a hard die placed inside the mold, the die defining a receiver which has a longitudinal axis, at least one tooling member and a material charge placed in the receiver, such that when the hard die, tooling member and charge are sealed in the mold, pressure applied to the sealed mold will force the tooling member and the charge together to cause uniaxial compaction of the charge in the receiver along the longitudinal axis of the receiver. Preferably the charge is compacted between at least two tooling members. The charge also may be simultaneously compacted transverse to the longitudinal axis by a lateral tooling member.

16 Claims, 3 Drawing Sheets

METHOD FOR UNIAXIAL COMPACTION OF MATERIALS IN A COLD ISOSTATIC PROCESS

BACKGROUND OF THE INVENTION

This invention relates to cold isostatic processing of compactible materials.

Die-compaction is the dominant method of pressing powder materials into complex shapes of accurate dimensions. However, this method is limited to forming parts of small to moderate cross-sectional area. The obtainable compaction is generally in two directions along a single axis, and suffers from frictional drag between the die and powder particles which can result in non-uniform densities within the pressed material. These non-uniformities in density become more evident as the axial thickness increases. Also, as cross-section of the part to be produced increases a greater total pressure is required for compaction. Such tonnage requirements become a practical limitation on this process, and die-compaction is therefore commonly referred to as "force-limited".

Isostatic pressing is another process for forming of components from particulate materials. In cold isostatic pressing (CIP), a powder charge is loaded into an elastomeric mold (called a "bag"). The bag can be considered as a hermetically sealed pressure transfer membrane. The bag may be part of the pressurization (containment) vessel (dry bag process) or may be a separate unit inserted into the pressurization vessel (wet bag process). In either case, a mandrel may be included within the bag to aid in forming details of the pressed material.

The sealed flexible bag is sealed within the Pressurization vessel and is then exposed to a pressurized fluid environment to promote material consolidation/compaction. In operation, the fluid is pressurized and this in turn applies a hydrostatic pressure to the loaded bag. The bag transfers the fluid pressure to the powder. This isostatically compresses the powder charge, at ambient temperatures, within the pressurization vessel. If a mandrel is included inside the bag, then the pressure compacts the powder against the mandrel Upon completion of the CIP process, the pressure is relieved and the pressure vessel is unsealed. The bag is then removed and opened. The part (called a "compact") is separated from the bag and mandrel. The surface formed by the elastomeric bag leaves a mottled surface on the compact, while a smooth or detailed surface is left by the mandrel according to the surface finish on the mandrel. This process results in near net shaping of components with generally uniform as-pressed densities The compact is then thermally treated, i.e., sintered, to increase its strength through diffusion bonding, and is machined to net shape as required.

Isostatic pressing is generally considered to be non-force limited because of its greater capacity of pressure transfer, versus the conventional die-compaction process. Compared with die compaction, isostatic compaction tends to provide more uniform pressure distribution within a powder charge, with greater density uniformity in the resulting compact, essentially as a benefit of the absence of the die-wall friction which is associated with the mechanical pressing process. Consequently, isostatic compaction yields increased and more uniform density at a given compaction pressure. As a result of the available capacity of compaction pressure and uniform pressure distribution, the cross-section to height ratio is not a limiting feature in isostatic pressing as it is with mechanical die-compaction.

Another benefit of the isostatic process is the elimination of the die lubricants used in mechanical pressing. Typically these lubricants are mixed into the powder charge to facilitate compact ejection from the die and to avoid cold welding of the compact to the die wall, in the mechanical pressing. Absence of these mixed-in lubricants in isostatic processing permits higher pressed densities and eliminates problems associated with use of die lubricants, such as Potential contamination of the compact or the need for removal of the lubricant prior to sintering which can cause blistering.

SUMMARY OF THE INVENTION

In practice of the present invention, a modified CIP processing arrangement is disclosed which enjoys the benefits associated with CIP and the benefits associated with the uniaxial compression available from a rigid die and punch. As a result, it is possible to increase the size, complexity and surface quality of resulting compacts. A preferred embodiment of the present invention employs hard tooling, with which isostatic pressure from the pressurization fluid is converted to an essentially axial compression force against the powder charge. In an alternative embodiment, both axial and selected lateral compaction is achieved to form compacts with complex shapes.

In one aspect of the invention a cold isostatic pressing method and apparatus using fluid Pressure to compact a material charge held in a flexible mold, including a hard die placed inside the mold, the die defining a receiver which has a longitudinal axis, at least one tooling member and a material charge placed in the receiver, such that when the hard die, tooling member and charge are sealed in the mold, pressure applied to the sealed mold will force the tooling member and the charge together to cause uniaxial compaction of the charge in the receiver along the longitudinal axis of the receiver. Preferably the charge is compacted between at least two tooling members. The charge also may be simultaneously compacted transverse to the longitudinal axis by a lateral tooling member.

Other features and advantages will become apparent from the following detailed description when read in connection with the accompanying drawings.

DETAILED DESCRIPTION OF A PREFERRED EMBODIMENT

Figure 1:
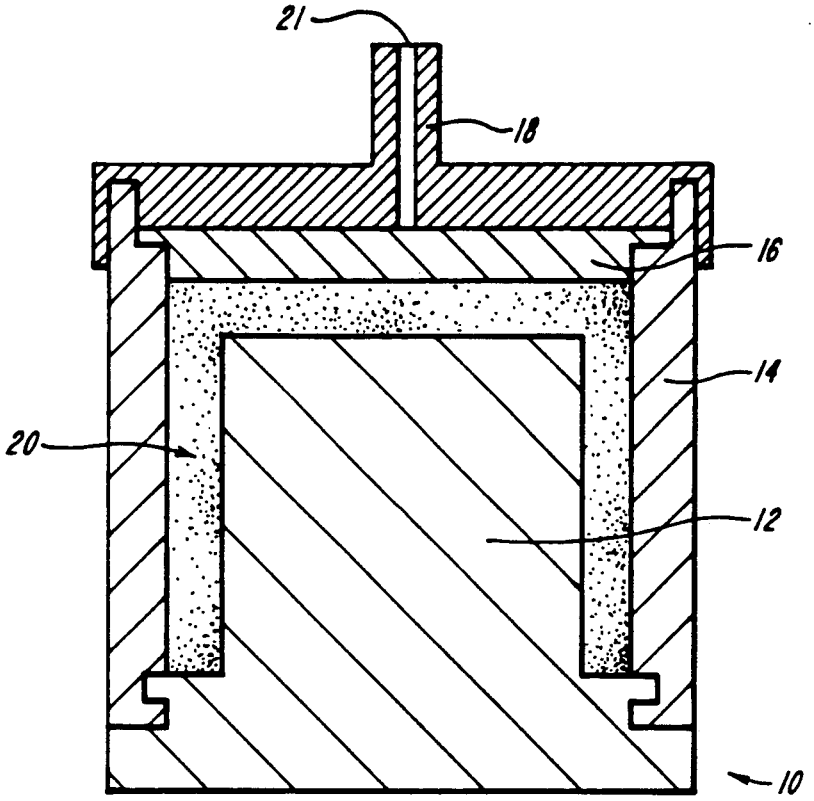
FIG. 1 (PRIOR ART)
FIG. 1 is a side cross-section of a prior art CIP wet bag assembly.

FIG. 1 shows a prior art CIP mandrel 12, elastomeric mold 14, mold cap 16 and closure 18 as form a conventional wet bag assembly 10. In use, powder 20 is loaded into the flexible mold along with the mandrel and then the mold is closed with the cap and closure. Bag assembly 10 is then placed in a Pressurization vessel (not shown). A pressurized fluid medium then applies a hydrostatic force to the bag assembly to isostatically compact the powder charge. Closure 18 is provided with a vent 21 for outgassing the thus enclosed environment which aids in sealing the mold, especially during decompression.

Figure 2:
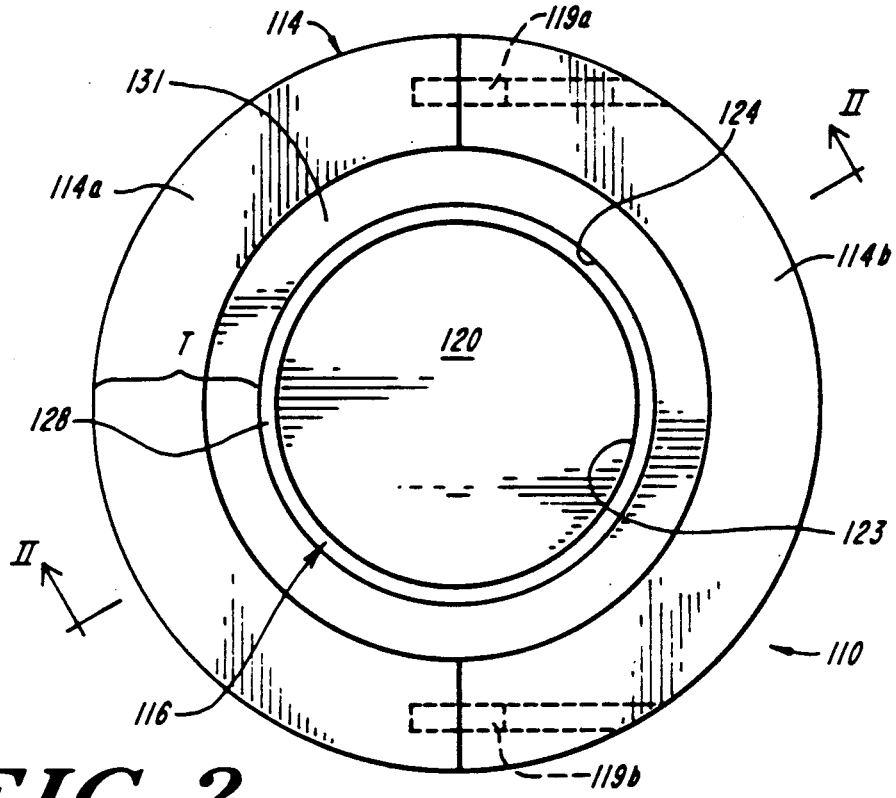
FIG. 2 is a top view of a CIP assembly in practice of the present invention.
Figure 3:
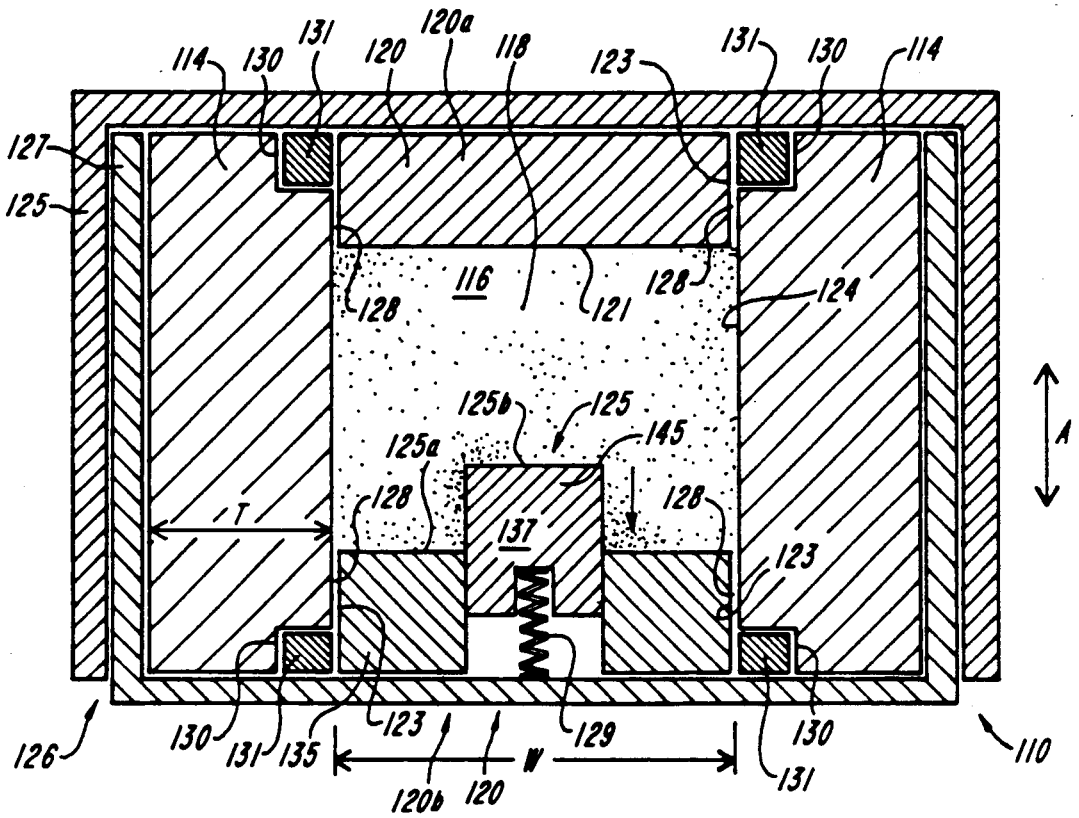
FIG. 3 is a side cross-section of a CIP wet bag assembly in practice of the present invention.
Figure 4:
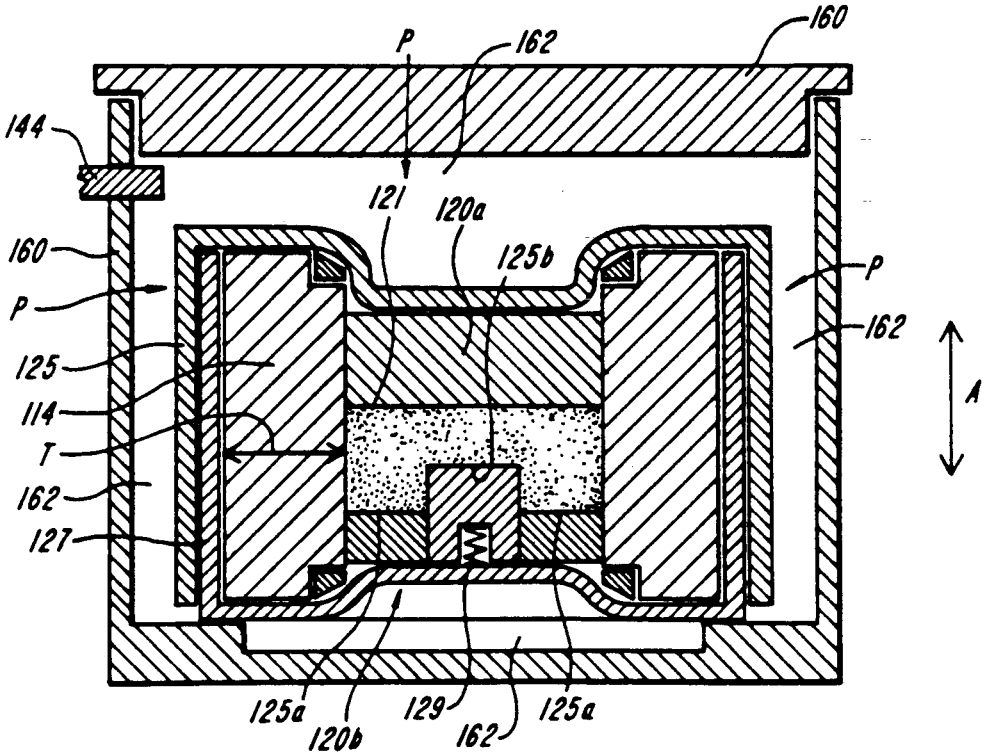
FIG. 4 is a side cross-section of the wet bag of FIG. 3 in a pressure vessel after compaction of the powder charge.

A preferred CIP compression apparatus 110 in practice of the present invention is shown in FIGS. 2, 3, and 4, where die 114 (such as a cylindrical die) has an internal cavity 116 for receipt of a material charge 118. The die is also provided with upper and lower tracks 130, into which a respective buffer ring 131 is fitted. This compression apparatus further includes punches 120 at each end of cavity 116. Bag assembly 126, includes a top membrane 125 and a bottom membrane 127, both of which mate together in an overlapping manner to enclose die 114, rings 131, charge 118 and punches 120 in a hermetically sealed, assembly.

Some free space or clearance 128, on the order of a fraction to several thousandths of an inch, is provided between the edges 123 of punches 120 and the vertical die interior wall surface 124. This clearance enables compaction of charge 118 by travel of punches 120 inwardly toward the center of the cavity along the cavity longitudinal axis (arrow A), without undue frictional contact of the punches with the die interior wall. A thin film of lubricant is applied to the die walls to enhance sliding of the punch and compaction of the powder charge. However, lubricant need not be mixed into the powder charge itself, as in conventional mechanical die compaction methodology due in part to the much slower production rates associated with the C.I.P. process.

In operation, the loaded tooling assembly (i.e., a compression apparatus) 110 is placed into and sealed within pressurization vessel 130. Pressurized fluid is then pumped into the vessel via inlet 144 to apply a hydrostatic pressure P to the contents of the vessel. The fluid pressure applied directly to the die does not compact the powder. Only the punches compress charge 118 as they are driven inwardly by the fluid pressure along compression axis A.

The die walls are chosen to be sufficiently thick and rigid to withstand the fluid pressure P without flexing. The tensile strength and associated modulus of elasticity of the die material, the cavity size and the applied fluid pressure determines the minimum required wall thickness T of the die walls to prevent the walls from [deforming]deflecting inwardly into the compaction path.

Figure 5:
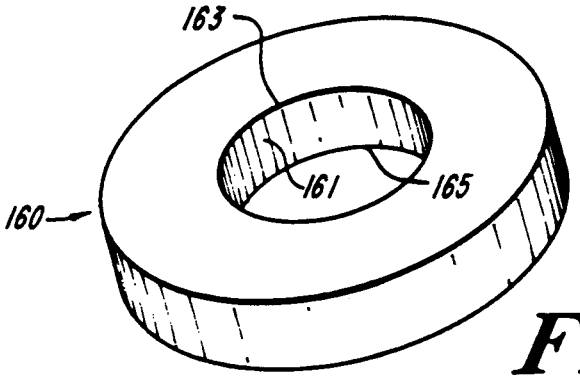
FIG. 5 is a perspective view of a cylindrical die.

A conventional cylindrical die 160 is shown in FIG. 5, having interior cylinder wall 161. The wall terminates at top and bottom edges 163, 165; these edges form sharp die corners. Since the bag material typically will freeze under pressure against a metallic die, the membrane will then shear and/or rupture at the die corners if the plungers travel too far inward along the compression axis A. To alleviate this problem, instead of allowing the die to terminate in sharp die corners, tracks 130 are provided as a seat for a respective buffer ring 131. These buffers, preferably formed of an elastomeric material, replace the hard die corners (where the bag stretch is greatest). The rings increase the amount of stretching which the elastomeric bag material can tolerate during compaction without tearing or rupturing.

In practice of the invention, a split tool steel die may be employed with good results. As shown in FIG. 2, the split die 114 includes mating pieces **114*a*, 114*b*, which are held by pins 119*a*, 119*b***. Use of the split die is desired because of the ease with which the die can be assembled and disassembled before and after compaction.

It is also possible to form the punches 120 with face detailing (such as step 145 in FIG. 3) for forming of compacts with complex shapes. In any event, the split die is split open after pressing to enable removal of the compact and associated tooling members.

Figure 6:
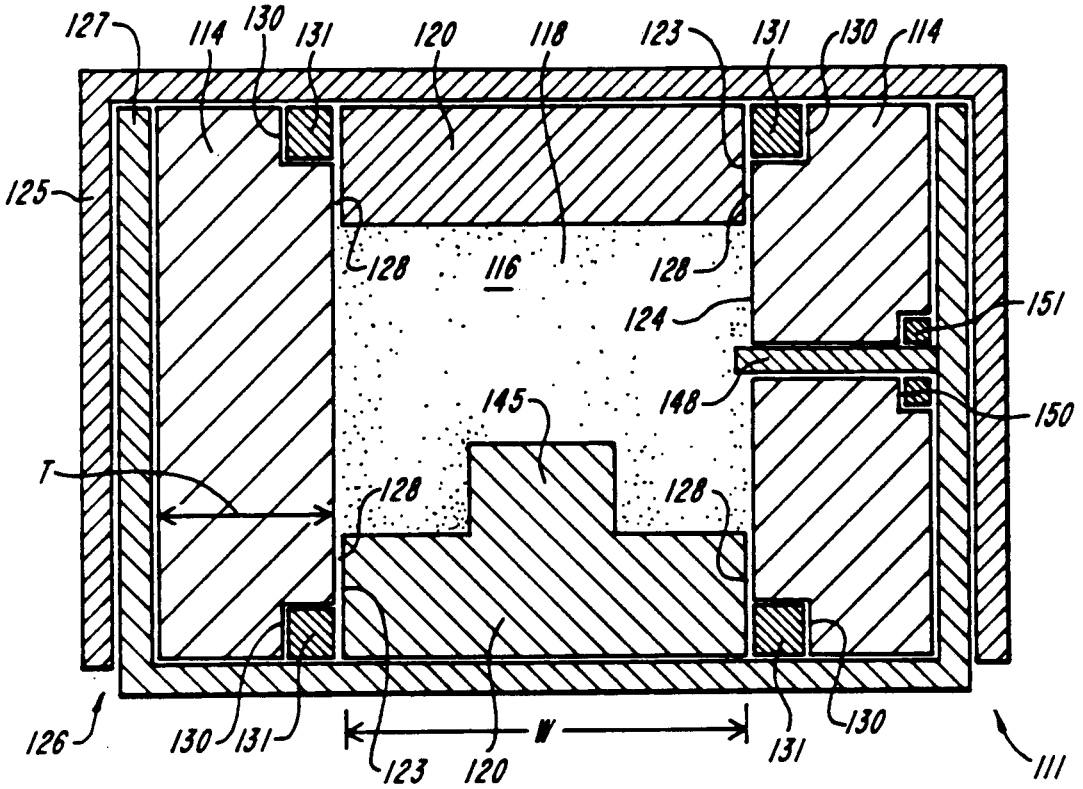
FIG. 6 is a side cross-section of a modified version of the assembly of FIG. 3.

As shown in the alternative tooling assembly 111 of FIG. 6, it is further possible to provide lateral compaction via a side punch 148, for laterally forming of internal lips and orifices or other details in the compact. The side punch is forced under pressure inwardly to compact the powder charge, and then is removed during the disassembly of the split die. The side punch may be provided with a buffer ring 151 fitted into track 150, for the buffering purposes described above with respect to buffer rings 131 and tracks 130.

Figure 4A:
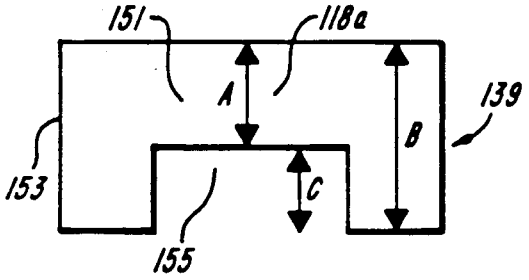

In the embodiment of FIGS. 3 and 4, two punches **120*a*, 120*b*, are shown. These punches are dissimilar. A first of the punches, punch 120*a*, for convenience of illustration and not by way of limitation, is shown having a flat compression surface 121. The second punch, 120*b*, has a compaction surface 125, as described below. The powder charge 118 is compacted between compression surfaces 121 and 125 into compact 139, as shown in FIG. 4*a***.

More particularly, in this embodiment, lower punch **120*b* includes an outer member 135 and an inner member 137, the inner member is spring loaded against spring 129. The top surfaces 125*a*, 125*b*, respectively, of outer member 135 and inner member 137 form the compaction surface 125. The lower punch 120*b* is loaded into one end of cavity 116. Inner member 137 rides on spring 129. The powder charge 118 is filled over compression surface 125 of punch assembly 120*b*, and punch 120*a*** is placed upon the powder charge.

Spring 129 is relatively light-duty, perhaps having a fifty to two hundred pound deflection rating. The spring is selected (1) to maintain the inner member in an elevated condition until the compaction process begins, but (2) to permit the inner member to travel into outer member 135 during the compaction process.

The travel of inner member 137 is designed in view of desired powder compaction. For example, compact 139 is shown in FIG. **4*a* having an inner section 151 of one inch height and an outer section 153 of two inches height, after compaction. Considering the inner section 151 and outer section 153 as separate elevations, their ratio may be considered as 2:1. In order that power 118 be uniformly compacted across the entire compact 139, the spring 129 elevates the inner section 137 so that powder charge 118 may be filled in a precompaction fill ratio comparable to the 2:1 as-compacted ratio. Hence, if the powder is filled, for example, four inches above surface 125a of outer member 135, prior to compaction, then the top surface 125*b* of inner member 137 would be elevated by spring 129 to two inches above surface 125*a* of the outer member 135**, so as to obtain a 2:1 precompaction fill ratio.

In this example, the inner member 137 is further configured to have a height greater than the height of the outer member such that upper surface **125*b* of the inner member will be one inch above upper surface 125*a* of the outer member at full compaction. This will enable creation of the one inch detail 155 within compact 139, while the outer member and inner member as a unit travel inwardly along axis A as does upper punch 120***a* up to a one inch separation between inner member upper surface 125*b* and surface 121 of punch 120*a*. Now the two inch powder fill above surface 125*b* can be compacted to one inch height and the four inch fill above outer member top surface 125*a* can be compacted to two inches height, according to the desired 2:1 compaction ratio in this example. Furthermore, it will be appreciated that this example can be extended generally to obtain greater uniformity of compaction in compact 139 in practice of the uniaxial compaction of the invention.

As a result of the present invention, parts of large cross-sectional area can be made with a Process in the nature of a heretofore force-limited axial mechanical pressing arrangement but with the benefits of non-force limited CIP. Large parts can be made to a near net configuration, possessing complex shapes, and exhibiting excellent surface finishes.

This process reaches practical limits as to the cross-sectional area of a compact which can be formed only according to the size of the containment vessel into which the tooling assembly is loaded, the size of the die, the thickness of the die walls, and the cross-sectional area of the punches. To the contrary, mechanical presses are limited by the practical tonnage limits of applying axial force over a given cross-sectional area.

Another benefit of the invention is that a compact can be formed with net or near net shape surfaces. Since the bag does not contact the powder, the mottled finish of prior art CIP is thus eliminated, while the punches can provide a smooth or detailed finish as desired.

Other embodiments are within the following claims.

What is claimed is:

1. A cold isostatic pressing method using fluid pressure to compact a material charge held in a flexible mold, the method comprising the steps of placing a hard die inside the mold, the die defining a receiver which has a longitudinal axis, and placing at least one tooling member and a material charge in the receiver such that when the hard die, tooling member and charge are sealed in the mold, pressure applied to the sealed mold will force the tooling member and the charge together to cause uniaxial compaction of the charge in the receiver along the longitudinal axis of the receiver.

2. The method of claim 1 further comprising the step of placing another tooling member in the receiver such that the charge is compacted between at least two tooling members.

3. The method of claim 2 wherein one of the tooling members is in a fixed location in the receiver.

4. The method of claim 2 wherein the tooling members and die are substantially inflexible during compaction of the charge.

5. The method of claim 2 wherein the die comprises a split die.

6. The method of claim 5 wherein the receiver comprises an open-ended cavity running through the die.

7. The method of claim 6 wherein the tooling members are punches.

8. The method of claim 2 wherein the receiver comprises an interior wall structure running along the longitudinal axis and which defines a receiver cavity, and wherein the tooling members fit into the cavity defined by the wall, with a few thousandths of an inch separation between the sides of the toolings and the inside of the receiver cavity.

9. The method of claim 8 further comprising the step of lubricating the interior wall, followed by placing the charge in the receiver cavity between axially moveable tooling members.

10. The method of claim 2 further comprising the step of hermetically sealing the die, tooling members and charge in the mold.

11. The method of claim 10 further comprising the step of sealing the sealed mold in a pressure chamber and subjecting the sealed mold to a pressurized fluid environment to cause compaction of the charge in the receiver along the receiver longitudinal axis.

12. The method of claim 1 wherein the die and/or tooling member is comprised of tool steel or comparable material such as ceramics possessing a high modulus of elasticity, fracture toughness and abrasion resistance.

13. The method of claim 1 wherein the material charge is a particulate powder or compressible material.

14. The method of claim 8 wherein the tooling members fit within a few thousandths of an inch or less of the die receiver wall.

15. The method of claim 1 wherein the mold is an elastomeric membrane.

16. The method of claim 1 further comprising the step of simultaneously compacting the charge along a selected axis transverse to the longitudinal axis using a lateral tooling.

* * * * *